United States Patent [19]

Schäfer et al.

[11] B 3,986,829

[45] Oct. 19, 1976

[54] PROCESS FOR FELT PROOFING AND DIMENSIONALLY STABILIZING TEXTILES MADE OF FIBERS WHICH CONTAIN KERATIN

[75] Inventors: Karl Schäfer, Opladen; Hans Schuster, Schildgen; Dieter Dieterich, Leverkusen, all of Germany

[73] Assignee: Bayer Aktiengesellschaft, Leverkusen, Germany

[22] Filed: Aug. 17, 1973

[21] Appl. No.: 389,304

[44] Published under the second Trial Voluntary Protest Program on January 27, 1976 as document No. B 389,304.

[30] Foreign Application Priority Data

Sept. 1, 1972 Germany ..... 2243159

[52] U.S. Cl. ..... 8/115.7; 8/112; 8/127.5; 8/127.6; 8/128 A; 8/128 R; 260/29.2 TN; 427/389; 428/265; 428/270; 428/290

[51] Int. Cl.[2] ..... D06M 3/06; D06M 3/08; D06M 3/02; D06M 15/52; D06M 15/10

[58] Field of Search ..... 8/128 A, 128 R, 127.51, 8/127.6, 115.7, 127.5, DIG. 11, 112; 117/141; 427/389; 260/29.2 TN; 428/265, 270, 290

[56] References Cited

UNITED STATES PATENTS

| | | | |
|---|---|---|---|
| 3,498,740 | 3/1970 | Cain | 8/127.6 |
| 3,558,264 | 1/1971 | Habib | 8/127.6 |
| 3,686,026 | 8/1972 | Schafer et al. | 117/141 |
| 3,687,605 | 8/1972 | Farmer | 8/127.6 |
| 3,814,578 | 6/1974 | Pittman et al. | 8/127.6 |
| 3,832,133 | 8/1974 | Culbertson et al. | 8/127.6 |

*Primary Examiner*—Benjamin R. Padgett
*Assistant Examiner*—T. S. Gron
*Attorney, Agent, or Firm*—Lawrence S. Pope; Gene Harsh

[57] ABSTRACT

A simple and economical one-step process for felt-proofing and dimensionally stabilizing textiles, particularly textiles based on keratinous fibers is disclosed. In the process, the textiles are treated with aqueous baths which contain salts of sulfurous acid or pyrosulphites as reducing agents and polyurethanes which contain onium groups.

10 Claims, No Drawings

PROCESS FOR FELT PROOFING AND DIMENSIONALLY STABILIZING TEXTILES MADE OF FIBERS WHICH CONTAIN KERATIN

It is already known to use reducing agents for dimensionally stabilizing textiles made of fibers which contain keratin. U.S. Pat. No. 3,498,740 and German Offenlegungsschrift No. 1,906,514 disclose two-stage finishing processes by which fiber material which contains keratin is felt-proofed and dimensionally stabilized. The textile is either treated with a reducing agent in the first stage and with a polymer compound such as a high-molecular weight polyisocyanate in the second stage or conversely. Dimensional stability as used herein means the ability of a fabric to retain its shape and size after being worn, washed and dry cleaned. Felt-proofing means that no change of the surface properties of the textile owing to shrinking or felting occurs when it is washed with the usual detergents.

U.S. Pat. No. 3,686,026 describes the use of self-dispersible isocyanate polyaddition products which contain onium groups for the feltproofing of textiles which contain keratin fibers.

The known two-stage processes are complicated and expensive to apply. Moreover, some fabrics which contain keratin fibers, for example certain knitted goods such as double jersey or felts such as clothing or interlining felts and interfacings cannot be sufficiently dimensionally stabilized by the known processes.

It is an object of this invention to provide a simple and economical process by which textiles made of fibers which contain keratin can be given a permanent felt-proof finish and permanently stabilized in its dimensions.

It has now surprisingly been found that a single-bath application of aqueous liquors which contain salts of sulphurous acid or pyrosulphites as reducing agents as well as polyurethanes which contain onium groups produce excellent resistance to felting and dimensional stability even in the textile materials mentioned above.

This invention therefore relates to a process for the felt-proofing and dimensional stabilization of textiles made of fibers which contain keratin, characterized in that the textile is treated with aqueous baths which contain both salts of sulphurous acid or pyrosulphites as reducing agents and polyurethane products which contain onium groups.

Suitable salts of sulphurous acid or pyrosulphites useful as reducing agents are e.g. alkali metal salts such as sodium bisulphite, sodium sulphite, sodium pyrosulphite, potassium bisulphite, potassium sulphite or potassium pyrosulphite, ammonium sulphite, hydrazine sulphite or methyl hydrazine sulphite, and salts of aliphatic amines such as ethylamine, propylamine, monoethanolamine, diethanolamine, triethanolamine, ethylenediamine, N,N,N',N'-tetramethylethylenediamine, triethylenediamine, permethyl diethylenetriamine or hexamethylene diamine.

It is particularly preferred to use salts of sulphurous acid which are obtained by mixing sodium bisulphite with equivalent quantities of ammonia or the amines mentioned above.

The polyurethanes with onium groups used according to the invention are preferably compounds containing sulphonium or ammonium groups which can be obtained by ternising sulphides such as thiodiglycol or quaternizing amines such as pyridine or tributylamine with polyaddition products of an organic polyisocyanate and an organic polyhydroxyl compound which contain reactive halogen atoms by the process described in U.S. Pat. No. 3,686,026.

Polyaddition products with reactive halogen atoms suitable for this purpose are those which are formed by the reaction of a prepolymer of organic polyisocyanates and organic polyhydroxyl compounds which contain 2–7 percent by weight of free isocyanate groups with a halogenated carboxylic acid or its amide, e.g. bromoacetic acid, chloroacetic acid or chloroacetamide, or a halogenated alcohol such as bromoethanol or chloroethanol.

The prepolymer is preferably prepared from organic compounds with a molecular weight of 300–10,000 preferably 500–6000, which contain at least 2 hydroxyl groups and a molecular excess of an organic diisocyanate.

The higher molecular weight compounds which contain at least 2 hydroxyl groups may be, for example, polythioethers, polyesters, polyester amides or polyamides but are preferably polyethers.

The polyethers may be, for example, polymerization products of ethylene oxide, propylene oxide, tetrahydrofuran, or butylene oxide or their copolymerization or graft polymerization products or polyethers obtained by the condensation of polyhydric alcohols or mixtures of polyhydric alcohols or by alkoxylation of polyhydric alcohols, such as glycerine, trimethylol propane, 1,2-propylene glycol; amines, such as $NH_3$; polyamines such as ethylene diamine and amino alcohols such as ethanol amine.

Suitable polythioethers are in particular the condensation products of thiodiglycol with itself and/or with other glycols, such as ethylene glycol, dicarboxylic acids, such as adipic acid, formaldehyde, amino-carboxylic acids such as glycerine or amino alcohols such as ethanol amine. The products obtained are either polythioethers, polythio mixed ethers, polythioether esters or polythioether ester amides, depending on the starting components used. These polythioethers which contain hydroxyl and/or carboxyl groups may also be used in the alkylated form or as mixtures with alkylating agents.

The polyesters, polyester amides and polyamides used may be, for example, polycarbonates or other predominantly linear condensation products obtained from polybasic and especially dibasic saturated or unsaturated carboxylic acids such as adipic acid or maleic acid or their anhydrides and polyvalent saturated or unsaturated alcohols such as ethylene glycol and 1,4-butene diol; amino alcohols such as propanol amine, diamines such as ethylene diamine, polyamines such as 1,3,6-hexane triamine, or mixtures thereof. Polyesters of lactones such as caprolactone or polyesters of hydroxycarboxylic acids such as hydroxy acetic acid may also be used.

Apart from the various types of compounds mentioned above, polyhydroxyl compounds which contain basic nitrogen atoms may also be used, e.g. polyalkoxylated primary amines or polyesters or polythioethers which contain alkyl diethanolamine incorporated by condensation, or polyhydroxyl compounds which contain compounds with reactive halogen atoms such as glycerol-$\alpha$-chlorohydrin incorporated by condensation. The polyhydroxyl compounds which contain basic nitrogen atoms may also be in the alkylated form, i.e. the onium form. Polyhydroxyl compounds which contain urethane or urea groups and modified or unmodified natural polyols such as carbohydrates and hydroxycarboxylic acids such as castor oil may also be used. The following are mentioned as examples of suitable organic polyisocyanates: aliphatic diisocyanates such as tetramethylene diisocyanate and hexamethylene diisocyanate, cycloaliphatic diisocyanates such as cyclohexane-1,4-diisocyanate, dicyclohexylmethane-4,4'-diisocyanate and hexahydrotolylene-2,4- and -2,6-diisocyanate and araliphatic diisocyanate such as p-xylylene diisocyanate; diisocyanates which contain sulphur, for example those obtained by reacting 2 mols of hexamethylene diisocyanate with 1 mol of thiodiglycol or dihydroxy dihexylsulphite; triisocyanates such as the reaction product of 3 mols of hexamethylene diisocyanate and 1 mol of water. Aromatic polyisocyanates such as 4,4'-diphenylmethane diisocyanate are less suitable because the polyaddition products produced from them are easily discolored or degraded in the presence of light. Aliphatic polyisocyanates are preferred, especially hexamethylene diisocyanate.

The finishing baths used according to the invention are prepared by mixing the polyurethane products which contain onium groups with a surface-active non-ionogenic emulsifier and then diluting the mixture with water and stirring.

Suitable surface-active non-ionogenic compounds are, for example, the ethoxylation products of alkyl phenols, fatty alcohols and fatty acids. The quantity of surface-active non-ionogenic compounds used is 1–50 percent by weight, preferably 3–10 percent by weight, based on the cationic polyurethane product.

The polyurethane product which contains onium groups is used in concentrations of 30–200 g, preferably 70–100 g, per liter of finishing bath.

The aqueous solutions of the salts of sulphurous acid mentioned above are added to the polyaddition products dissolved or dispersed in water. The concentration of reducing agent used is 10–100 g, preferably 20–50 g per liter of aqueous bath.

The aqueous baths used according to the invention may in addition contain the following additives:

a. pH buffers such as sodium acetate, potassium acetate, sodium bicarbonate, sodium carbonate, borax, disodium phosphate or trisodium phosphate but preferably sodium acetate. These compounds are used in quantities of 1–10 g, preferably 5–6 g per liter of bath.

b. Compounds which have a swelling or dissolving action such as urea, dicyandiamide, formamide, dimethlformamide, dimethylacetamide, methanol, ethanol or isopropanol.

c. Plasticizers which improve the handle of the treated textile material.

Other finishing agents may also be added to the baths used according to the invention, e.g. perfluoroalkyl compounds, for example to provide a stain-resistant finish in addition to the felt-proofing and dimensionally stabilizing finish.

The baths according to the invention are applied either by immersing the textile in the bath and then removing excess liquid by squeezing or spinning or by spraying the textile with the bath.

After application of the finishing bath, the textile is dried at 90–110°C for 5–10 minutes and then condensed at 120° – 140°C from about 4 – 10 minutes. After condensation, the textile is treated with steam at about 100°C for about 3–5 minutes.

It is advantageous to wash the textile after this treatment with 1–2 g per liter of a non-ionogenic surface-active agent at 40°–45°C for 10–15 minutes.

Alternatively, after the textiles have been impregnated with the baths according to the invention, they may be dried at 90°–110°C, then treated for about 3–5 minutes, then condensed with steam at about 100°C at 120–140 percent and then washed as described above.

Textiles which have been treated according to the invention may be dyed and printed. They are not felted by the dyeing process.

As already mentioned above, it has been disclosed in U.S. Pat. No. 3,686,026 that textiles which contain keratin fibers can be felt-proofed by finishing them with an aqueous bath of polyurethanes which contain onium groups. To achieve complete freedom from felting, it is necessary to apply a certain miniumum quantity of the polyaddition products, depending on the nature of the textile. This often results in an excessively hard textile handle if the quantity of polyaddition product required to obtain sufficient felt-proofing is too high.

In the process according to the invention, on the other hand, the quantity of polyaddition compounds which contain onium groups can be considerably reduced without reducing the resistance to felting. A softer handle is therefore generally obtained. The treatment according to the invention may, of course, also be applied to a textile which contains other fibers, such as synthetic fibers or cellulose fibers, in addition to the keratin fibers.

The following examples illustrate the improvement in the properties of textiles with keratin fibers by the treatment with baths according to the invention.

EXAMPLE A

A pure wool clothing felt (200 g per square meter) was treated with aqueous baths containing the following substances per liter:

Experiment 1

100 g of the polyaddition product containing sulphonium groups described below and
5 g of sodium acetate.

Experiment 2

The same reaction mixture as in experiment 1; addition of 200 g of 20 % sodium bisulphite solution.

Experiment 3

The same reaction mixture as in experiment 1; addition of 50 g of isopropanol and 50 g of sodium sulphite dissolved in 150 g of water.

Experiment 4

The same reaction mixture as in experiment 1; addition of 50 g of monoethanolamine sulphite dissolved in 150 g of water.

Experiment 5

The same reaction mixture as in experiment 1; addition of 50 g of isopropanol and 200 g of a mixture of
500 g of sodium bisulphite solution (40%),
130 g of ammonia (25%) and
370 g of water.

Experiment 6

The same reaction mixture as in experiment 1; addition of 200 g of a mixture of
520 g of sodium bisulphite solution (40%);
60 g of ethylenediamine and
420 g of water.

Experiment 7

The same reaction mixture as in experiment 1; addition of 40 g of potassium pyrosulphite dissolved in 160 g of water.

Preparation of the polyaddition product containing sulphonium groups:

3000 g of a branched polyether with an average molecular weight of 3000 ± 200 and an OH-number of 56 ± 3, prepared from propylene oxide and trimethylolpropane and 535 g of hexamethylene diisocyanate were heated to 110°C for 2 hours and then to 130°–140°C for 1½ hours.

1000 g of the 80% by weight solution of the above reaction product (containing 3.9% of free isocyanate groups) in ethyl acetate were reacted with 112 g of bromoacetic acid at 30°C for 20 hours. The carbon monoxide liberated was continuously removed by vigorous stirring.

132 g of thiodiglycol were added to the reaction product at room temperature and stirring was continued for 1 hour. A highly viscous, yellowish substance was obtained. Preparation of the baths:

10 g of an ethoxylation product of 1 mol of nonyl phenol and 30 mol of ethylene oxide and 50 g of water were added to 100 g of the sulphonium-containing polyaddition product and the mixture was made up into a paste by stirring.

This mixture was diluted with 440 g of water, and a solution of 5 g of sodium acetate in 95 g of water was then added. 50 g of isopropanol or 50 g of water and the sulphite solutions were then added. The bath was then made up to a volume of 1 liter with water.

Application

The pure wool clothing felt mentioned above is immersed in the bath and then squeezed off to reduce the uptake of liquid to 100 percent. The felt is then dried at 100°C and condensed at 140°C for 4 minutes. It is then treated with steam at 100°C for 3 minutes.

After the steam treatment, the felt is washed with a nonionogenic detergent (2 g per liter) at 40°C for 10 minutes and dried.

The following table shows the excellent improvement in dimensional stability and freedom from felting in the clothing felt achieved by the treatment according to the invention. The freedom from felting was tested by treating the material in a Cubex apparatus for 60 minutes, using a bath ratio of 1:15.

| | % Surface shrinkage due to felting | Remark |
|---|---|---|
| Untreated textile: | 42.5 | completely felted |
| Experiment 1: Textile treated according to the invention | 25.1 | severely felted |
| Experiment 2: | 1.3 | smooth, clear appearance of fabric |
| Experiment 3: | 0.8 | smooth, clear appearance of fabric |
| Experiment 4: | 5.2 | smooth, clear appearance of fabric |
| Experiment 5: | 2.8 | smooth, clear appearance of fabric |
| Experiment 6: | 1.4 | smooth, clear appearance of fabric |
| Experiment 7: | 0.6 | smooth, clear appearance of fabric |

Experiments 2–7 were repeated in experiments 8–13 but without the addition of a polyaddition product containing onium groups.

The results are shown in the following table:

| | % Surface shrinkage due to felting | Remark |
|---|---|---|
| Experiment 8: | 37.1% | severely felted |
| Experiment 9: | 35.2% | severely felted |
| Experiment 10: | 36.1% | severely felted |
| Experiment 11: | 38.1% | severely felted |
| Experiment 12: | 34.1% | severely felted |
| Experiment 13: | 37.1% | severely felted |

It can be seen that dimensional stability cannot be achieved by treating the textile with reducing agents alone. Experiment 1 shows that a polyaddition product containing onium groups is not sufficient on its own to produce sufficient freedom from felting and dimensional stability in the textile.

Only the baths according to the invention (experiments 2–7) produce excellent permanent felt-proofing and dimensional stability.

EXAMPLE B

A wool fabric (210 g per square meter) was treated with aqueous baths containing the following substances per liter:

Experiment 1

30 g of the polyaddition product containing sulphonium groups described in example A and
5 g of sodium acetate.

Experiment 2

The same reaction mixture as in experiment 1 but using 100 g instead of 30 g of the polyaddition product containing sulphonium groups.

Experiment 3

The same reaction mixture as in experiment 1; addition of 50 g of sodium sulphite dissolved in 150 g of water.

Experiment 4

The same reaction mixture as in experiment 1; addition of 200 g of a mixture of 520 g of sodium bisulphite solution (40%),
92 g of methyl hydrazine and
388 g of water.

Experiment 5

The same reaction mixture as in experiment 1; addition of 200 g of a mixture of
520 g of sodium bisulphite solution (40%),
116 g of tetramethyl ethylenediamine and
364 g of water.

Experiment 6

The same reaction mixture as in experiment 1; addition of 40 g of potassium pyrosulphite dissolved in 160 g of water.

Preparation of the bath

The polyaddition product containing sulphonium groups is made up into a paste within 10% of an ethoxylation product prepared in Example A (based on the polyaddition product) and water by stirring in a manner analogous to Example A.

The bath is then diluted with water as in Example A and the aqueous solutions of sulphites are added.

Application

The wool fabric mentioned above is immersed in the baths and then squeezed off to reduce the uptake of liquid to 90 percent. The fabric is then dried at 100°C as in Example A and condensed at 120°C for 5 minutes. The fabric is then treated with steam at 100°C for 3 minutes, washed with a commercial non-ionogenic detergent (2 g per liter) at 40°C for 10 minutes and dried.

As can be seen from the following table, when using the textile treatment according to the invention, equally good freedom from felting can be obtained with only about one third the quantity of sulphoniumcontaining polyaddition product. A much softer textile handle can thereby be obtained.

The freedom from felting was tested by washing the textile in a domestic washing machine at a temperature of 60°C, using 3 g per liter of a commercial full detergent.

| | % Surface shrinkage due to felting after 10 washings at 60°C | Remark |
|---|---|---|
| Untreated textile | 12.8 | completely felted |
| Experiment 1: | 6.5 | felted |
| Experiment 2: Textile treated according to the invention | 0.8 | not felted |

-continued

| | % Surface shrinkage due to felting after 10 washings at 60°C | Remark |
|---|---|---|
| Experiment 3: | 0.6 | not felted |
| Experiment 4: | 1.2 | not felted |
| Experiment 5: | 0.4 | not felted |
| Experiment 6: | 0.8 | not felted |

EXAMPLE C

A pure wool interlining (110 g per square meter) was treated with aqueous baths containing the following substances per liter:

Experiment 1

80 g of the polyaddition product containing sulphonium groups described in example A, 5 g of sodium acetate and
3 g of urea.

Experiment 2

The same reaction mixture as in experiment 1; addition of 50 g of sodium bisulphite solution (40%). Preparation of the bath and application were carried out in a manner analogous to example A.

The following table shows the excellent finishing effects obtained on the interlining treated according to the invention (experiment 2):

| | % Surface shrinkage due to felting (tested in a Cubex apparatus, bath ratio 1:15, 60 minutes) | Remark |
|---|---|---|
| Untreated textile: | 45.6% | completely felted |
| Experiment 1: | 8.9% | felted |
| Experiment 2: | 1.4% | smooth, clear appearance of fabric, not felted |

EXAMPLE D

Example D shows the particularly good effect obtained with a single-bath application of reaction products which contain onium groups and sodium sulphite.

A pure wool clothing felt (200 g per square meter) was treated with aqueous baths containing the following substances per liter:

Experiment 1

110 g of the sulphonium-containing reaction products described in Example A in addition to 5 g of sodium acetate,
50 g of sodium sulphite and 160 g of water.

Preparation of the bath and application were carried out as described in example A.

Experiment 2 (two-bath process)

50 g of sodium sulphite and 2 g of a non-ionogenic surfaceactive agent. The clothing felt was immersed in the aqueous bath and squeezed off to reduce the uptake of liquid to 100 percent. The felt was then dried at 100°C for 10 minutes and treated with steam at 100°C for 3 minutes.

In a second stage, the felt was treated with an aqueous bath containing 110 g per liter of the reaction product containing sulphonium groups mentioned in example A and 5 g per liter of sodium acetate.

The clothing felt was immersed in the aqueous bath and squeezed off to reduce the liquid uptake to 100 percent. It was then dried at 100°C for 15 minutes and condensed at 140°C for 4 minutes.

The felt was finally washed in a commercial non-ionogenic surface-active agent for 10 minutes at 40°C.

Experiment 3: (two-bath process)

A sample of the clothing felt mentioned above was treated with an aqueous bath containing 110 g per liter of the reaction product containing sulphonium groups mentioned in example A and 5 g per liter of sodium acetate.

The clothing felt was immersed in the aqueous bath and squeezed off to reduce the liquid uptake to 100 percent.

The felt was then dried at 100°C for 10 minutes and condensed at 140°C for 4 minutes.

In the second stage, the felt was treated with an aqueous bath which contained 50 g per liter of sodium sulphite and 2 g per liter of a commercial non-ionogenic surface-active agent.

The clothing felt was immersed in the aqueous bath, squeezed off to reduce the liquid uptake to 100 percent, dried at 100°C and treated with steam at 100°C for 3 minutes.

It was finally washed with 2 g per liter of a commercial non-ionogenic surface-active agent at 40°C for 10 minutes.

The excellent finishing effects obtained in the pure wool clothing felt by the single-bath treatment according to the invention is shown in the following table.

| | % Surface shrinkage (tested in a Cubex apparatus, bath ratio 1:15 for 60 minutes) | Remark |
|---|---|---|
| Untreated textile: | 36.8 | completely felted |
| Experiment 1: | 1.4 | clear, open appearance of fabric; not felted |
| Experiment 2: | 11.3 | felted |
| Experiment 3: | 7.5 | moderately felted |

EXAMPLE E

A fabric made of 70 % wool and 30 % polyester fibres (160 g per square meter) was treated with an aqueous bath containing the following substances per litre:

100 g of the polyaddition product containing sulphonium groups described in Example A,
5 g of sodium acetate,
40 g of sodium bisulphite
50 g of isopropanol Preparation of the bath 100 g of the polyaddition product containing sulphonium groups are made up into a paste within 50 g of water and 10 g of an ethoxylation product from 1 mol of nonyl phenol and 30 mols of ethylene oxide by stirring in a manner analogous to Example A.

This mixture was diluted with 50 g of isopropanol and 390 g of water, and solutions of 5 g of sodium acetate in 95 g of water and of 40 g sodium bisulphite in 160 g of water. The bath was then made up to a volume of 1 litre with water.

Application

The fabric mentioned above is immersed in the bath and then squeezed off to reduce the uptake of liquid to about 100 percent. The textile is then dried at 100°C and condensed at 140°C for 4 minutes. It is then treated with steam at 100°C for 3 minutes.

After the steam treatment the textile is washed with a nonionic detergent (2 g per liter) at 40°C for 10 minutes and dried.

The following table shows the excellent improvement in dimensional stability and freedom of felting in the fabric achieved by the treatment according to the invention.

| | % Surface shrinkage due to felting | Remark |
|---|---|---|
| Untreated textile | 12.6 | completely felted |
| Textile treated according to the invention | 1.1 | smooth, clear apprearance of fabric |

EXAMPLE F

A fabric made of 50 % wool and 50 % cotton fibres (110 g per square meter) was treated with an aqueous bath according to Example E.

The following table shows the excellent improvement in dimensional stability and freedom of felting in the fabric due to the treatment according to the invention.

| | % Surface shrinkage due to felting | Remark |
|---|---|---|
| Untreated textile | 16.8 | completely felted |
| Textile treated according to the invention | 2.6 | smooth, clear appearance of fabric |

What is claimed is:

1. A single-bath process for imparting dimensional stability and felt-proofing to textiles containing at least some keratinous fibers which comprises treating said textile with an aqueous bath which contains salts of sulphurous acid or pyrosulphites as reducing agents and a polyurethane polymer having no free isocyanate groups which contains onium groups.

2. The process of claim 1 wherein the reducing agents are salts of sulphurous acid with alkali metals, ammonia, hydrazine, methyl hydrazine or an aliphatic amine.

3. The process of claim 1 wherein said polyurethane containing onium groups is dissolved or dispersed in water.

4. The process of claim 1 wherein the textile is dried after the treatment with the bath and then heated to a temperature of 100°C.

5. The process of claim 1 wherein said textile is treated with steam at 100°C after the textile has been dried.

6. The process of claim 1 wherein said polyurethane polymer which contains onium groups is used in a concentration of from about 30 to about 200 g per liter of finishing bath.

7. The process of claim 1 wherein said salt is an alkali metal salt of a sulphurous acid and is used in a concentration of about 10 to about 100 g per liter of said aqueous bath.

8. The process of claim 1 wherein said onium group is sulphonium.

9. A single-bath process for imparting dimensional stability and felt-proofing to textiles containing at least some keratinous fibers which comprises treating said textile with an aqueous bath which contains salts of sulphurous acid or pyrosulphites as reducing agents and an onium group containing polyurethane without free isocyanate groups prepared by the ternization of a sulphide or the quaternization of an amine with the reaction product of a prepolymer formed by the reaction of organic polyisocyanates and organic polyhydroxyl compounds which contains 2 to 7 wt% of free isocyanate groups with a halogenated carboxylic acid or its amide.

10. In a process for finishing textile material containing wool fibers which comprises treating said textile material with an aqueous liquor containing a self-dispersible polyurethane polymer containing onium salt groups and being free of isocyanate groups, followed by drying the thus treated textile material, wherein said product is a reaction product of:

a. a compound of molecular weight from 300 to 10,000 which contains at least two hydroxyls, at least two carboxyl, or at least one hydroxyl and one carboxyl group;

b. a polyisocyanate;

c. a compound which contains 1. at least one group capable of onium salt formation, and 2. at least one group which is reactive with an isocyanate group d. a compound which forms onium salts with the onium forming group (c) (1), the improvement wherein the aqueous bath also contains salts of sulphurous acid or pyrosulphites as reducing agents.

* * * * *